United States Patent [19]

Monks

[11] 4,235,475

[45] Nov. 25, 1980

[54] MINERAL MINING EQUIPMENT

[75] Inventor: Harry Monks, Burton-on-Trent, England

[73] Assignee: Coal Industry (Patents) Limited, London, England

[21] Appl. No.: 506,710

[22] Filed: Sep. 17, 1974

[30] Foreign Application Priority Data

Oct. 19, 1973 [GB] United Kingdom ..... 48747/73

[51] Int. Cl.[2] ..... E21C 29/10

[52] U.S. Cl. ..... 299/43; 299/34; 104/172 R

[58] Field of Search ..... 299/32, 34, 42, 43, 299/45, 46; 104/147 R, 162, 165, 172 R, 172 C, 173

[56] References Cited

U.S. PATENT DOCUMENTS

| | | | |
|---|---|---|---|
| 3,409,329 | 11/1968 | Domann et al. | 299/43 X |
| 3,602,549 | 8/1971 | Renzing | 299/43 |

FOREIGN PATENT DOCUMENTS

| | | | |
|---|---|---|---|
| 1050717 | 2/1959 | Fed. Rep. of Germany | 299/34 |
| 1195705 | 7/1965 | Fed. Rep. of Germany | 299/34 |

*Primary Examiner*—William F. Pate, III
*Attorney, Agent, or Firm*—James C. Wray

[57] ABSTRACT

A mineral mining machine hauls itself along a working face by engaging a round link chain. The links of the chain are fed sequentially from link-retaining pockets in a track component arranged around the working face, around a driven sprocket assembly on the machine and returned to the pockets.

7 Claims, 3 Drawing Figures

MINERAL MINING EQUIPMENT

This invention relates to a mineral mining equipment and in particular, although not exclusively, the invention relates to haulage equipment for use on a longwall working face where a mineral winning machine traverses to and fro on a path extending adjacent to an armoured face conveyor.

One known such haulage equipment comprises a flexible round link chain which is anchored at its ends adjacent to the ends of the working face, respectively, and which is drivably engaged by a drive sprocket on the machine so that the machine hauls itself along the stationary chain. Unfortunately such a haulage system suffers from the disadvantages associated with the tensioning of a long length of chain including the danger of the chain breaking and the non-constant length of the chain due to stretch.

In order to try and overcome the disadvantages associated with tensioning of a long length of chain it has been proposed to provide a rack which is secured to the armoured conveyor and which has formations engaged by corresponding formations provided on a driven flexible chain drivably engaged around a driven sprocket arrangement provided on the machine. Unfortunately, such haulage equipment has the disadvantage that the rack must be constructed to a very high tolerance which tends to make the cost of such haulage equipment high when compared with the cost of round link chain.

An object of the present invention is to provide haulage equipment for use on longwall working faces which tends to overcome the disadvantages associated with tensioning lengths of chain and which does not require use of a relatively expensive rack.

According to the present invention mineral mining equipment comprises a mineral mining machine which in use traverses to and fro along a path adjacent to an armoured face conveyor arranged along a mineral face and which has a sprocket assembly including at least one driven sprocket, a flexible round link chain at least a portion of which is extendable along at least a portion of the path of the machine such that during the traverse of the machine along the path links of the chain sequentially are associated with the sprocket assembly and sequentially are drivably engaged by the driven sprocket to haul the machine along the path, a track component for securing to the armoured face conveyor, the track component having formations for fixedly engaging those links of the chain which currently are not being fed around the sprocket assembly which is arranged to feed the associated links in sequence from the track component around the driven sprocket and back to the track component.

Preferably, the formations are pockets interconnected with a continuous groove, the pockets accommodating alternate links of the chain.

Advantageously, the machine has feet which slide along the track component to temporarily captivate the chain to the track component.

Conveniently, the machine comprises a scraper blade arranged to pass along the track component to clear the track component of any broken mineral before the chain links are re-engaged with the track component.

By way of example only, one embodiment of the present invention will be described with reference to the accompanying drawings in which.

Figure 1:
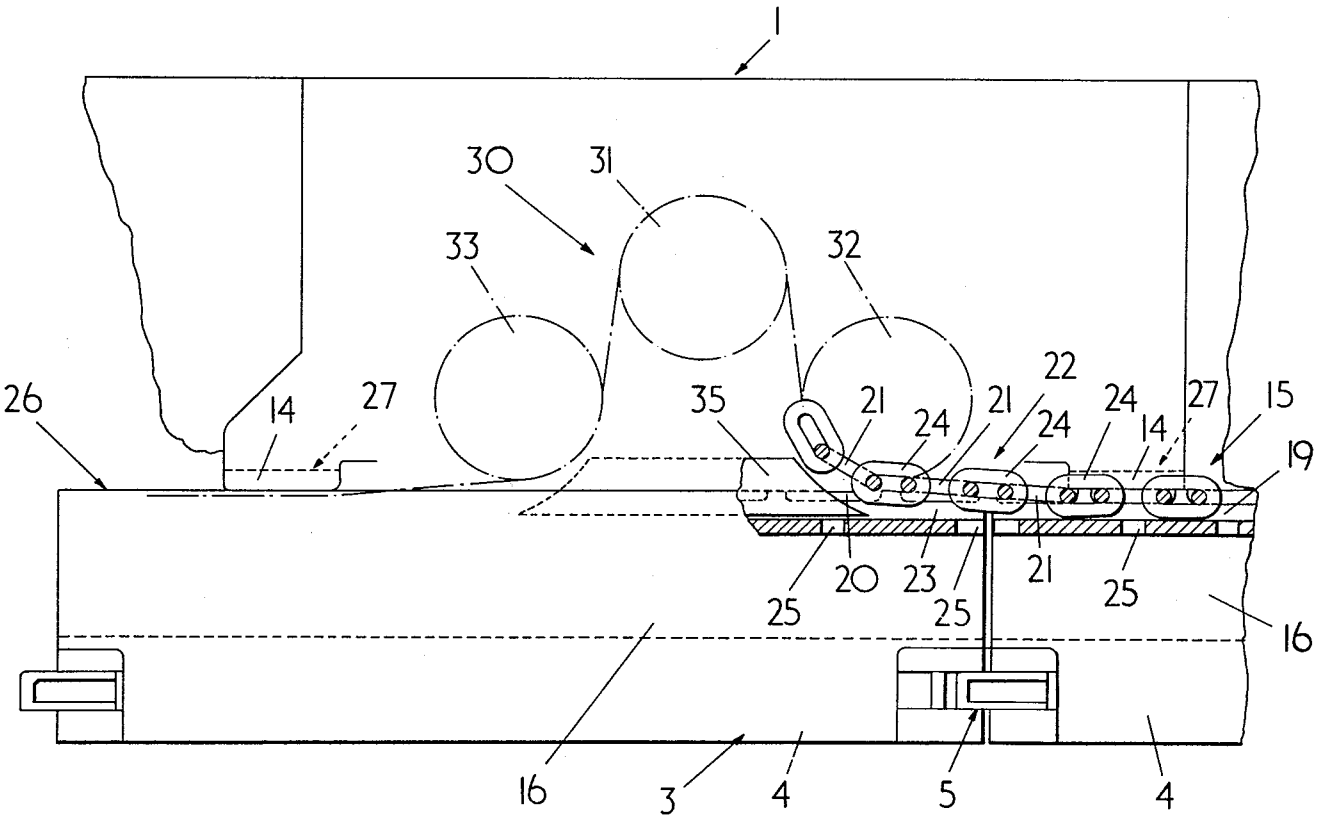
FIG. 1 is an incomplete part sectional side view of mineral mining equipment constructed in accordance with the present invention.

The drawings show part 1 of a longwall coal mining machine which in use traverses to and fro on a path extending along a longwall coal face and which has a rotary cutter head 2 (not shown in FIG. 1 of the drawings) arranged to win and load coal from the face during the traversing of the machine. The won coal is loaded by the action of the rotating cutter head onto an armoured face conveyor 3 extending along the longwall face. The conveyor 3 comprises a series of pans 4 which are connected articulately by a pin or slot arrangement 5 and each of which has two side walls 6 and 7 and a deck plate 8 over which a scraper bar and chain assembly (not shown) move to convey the broken coal in well known manner. The side walls 6 and 7 have upper and lower flanges 9 and 10 to retain the scraper bar and chain assembly in position. A ramp plate 11, secured to each of the side walls 6, helps guide broken coal onto the conveyor.

The machine has feet 13 and 14 arranged to slide along the upper flanges 9 of the side walls 6 and along an elonated track assembly 15, respectively. The track assembly 15 comprises a series of track components 16 each having an upright plate 17 secured towards its base 18 to the side wall 7 of the associated conveyor pan 4 and a slideway 19 extending along the upper edge of the upright plate 17.

Figure 2:
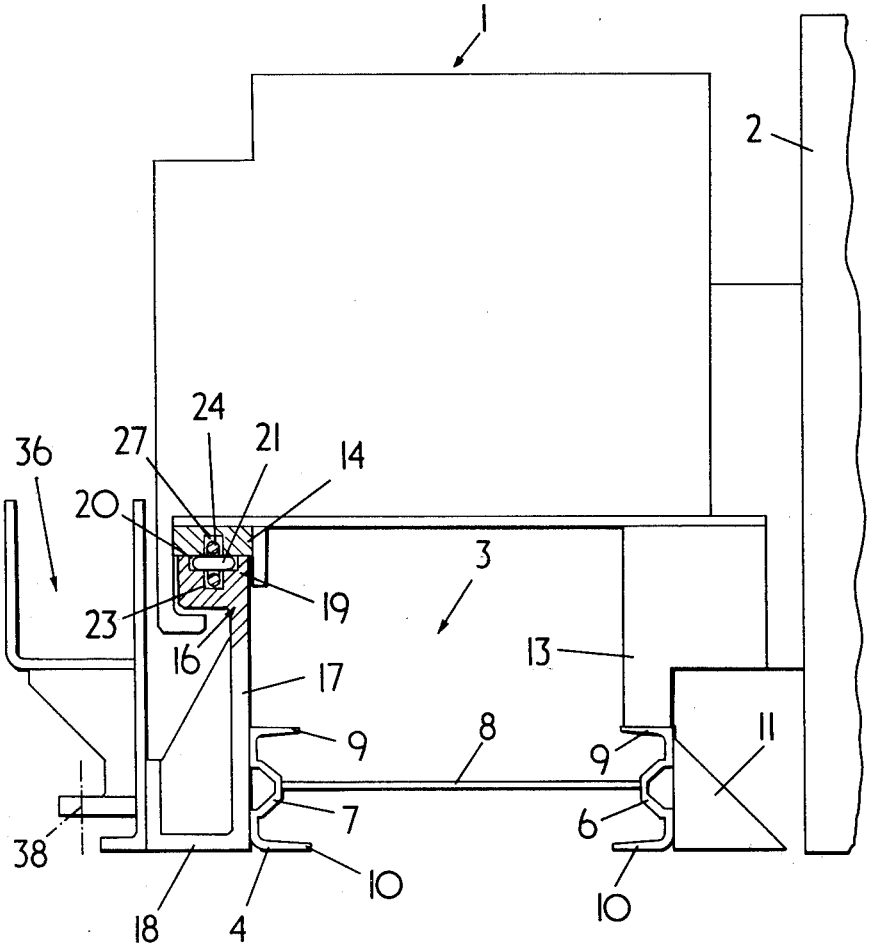
FIG. 2 is an incomplete end view of the equipment of FIG. 1.
Figure 3:
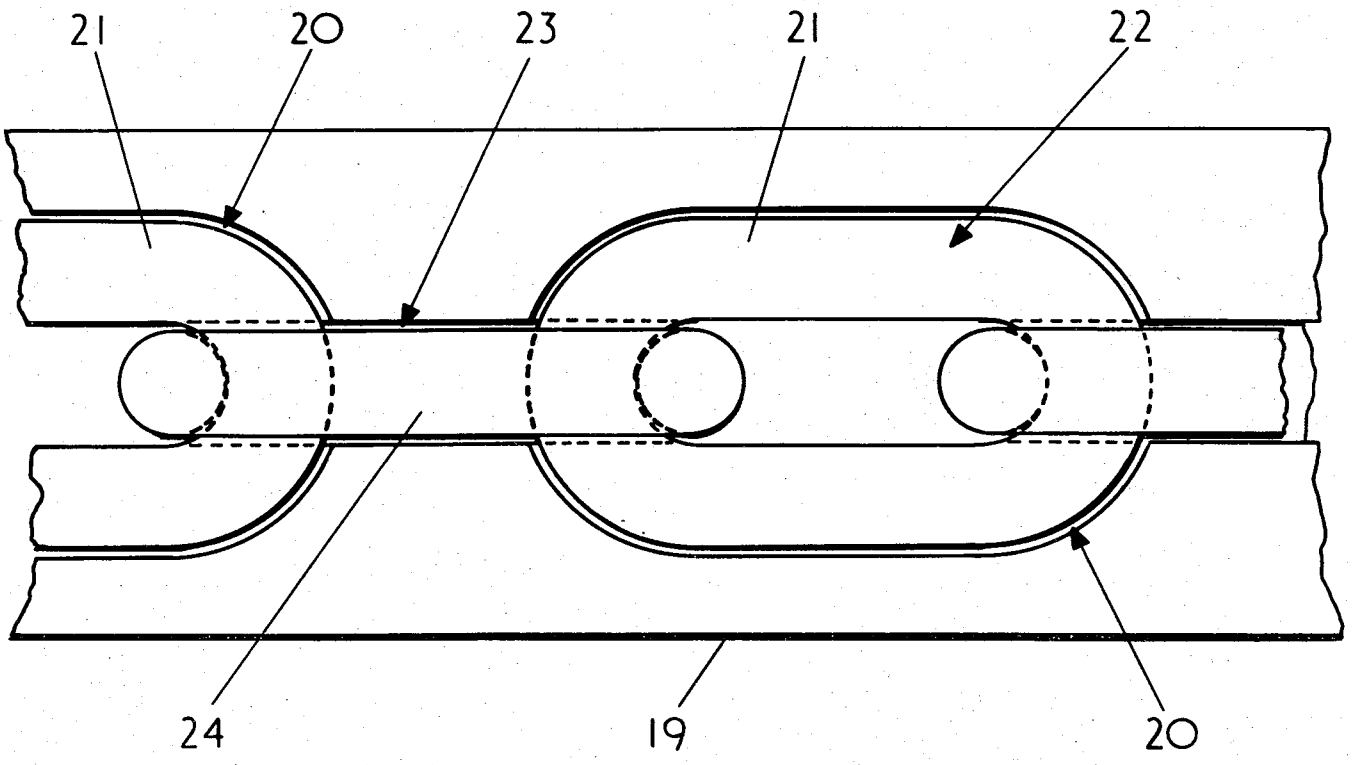
FIG. 3 is a plan of a detail of FIG. 1.

The slideway 19 has formations constituted by pockets 20 (see in plan in FIG. 3) for fixedly engaging alternate links 21 of a flexible round link chain (only a portion of which is shown) which extends the whole length of the machine's path. The pockets 20 are slightly larger than the links 21 and are interconnected by a continuous slot or groove 23 which accommodates the lower portions of the upright links 24 of the chain 22 as seen in FIG. 2. Holes 25 are provided in the bottom of the slideway 19 to help prevent broken coal building up in the groove 23.

The feet 14 on the machine slide along the upper face 26 of the slideway and extend partway around the slideway 19 to captivate the machine to the track assembly. The feet 14 captivate adjacent links 21 of the chain 22 in the pockets 20. A groove 27 is formed in the base of each of the feet 14 to accommodate the upper portion of the upright links 24.

The length of the chain 22 between the two feet 14 is associated with a sprocket assembly 30 which is provided on the part 1 of the machine and which includes a driven sprocket 31 and two guide idler sprockets 32 and 33. As the machine moves along its path the chain links associated with the sprocket assembly sequentially are fed from the adjacent track component 16 by the currently leading guide sprocket 32 or 33 (depending upon the direction of travel of the machine along its path) around the driven sprocket 31 where the links are drivably engaged sequentially by the teeth of the sprocket 31 and replaced in the pockets 22 of the track component 16 by the currently trailing guide sprocket 33 or 32. The feet 14 ensure that links of the chain adjacent to those associated with the sprocket assembly are captivated to the track component.

A scraper blade 35 is mounted on the part 1 of the machine and arranged to run along the continuous groove 23. The blade 35 ensures that the groove and pockets are kept free from broken coal so that the links of the chain can be correctly replaced in the track component. The blade 35 also serves to plough the links of the chain out of the track component pockets 20 ensuring that the links disengage the track component at the desired position relatively to the sprocket assembly.

The driven sprocket 31 is driven by an electric motor within the part 1 of the machine which is supplied by a flexible electric cable (not shown) accommodated within a trough 36 secured to the base of the track component 16. The trough 36 has bores (indicated at 38 in FIG. 2) for the attachment of conveyor advancing rams (not shown).

In use the machine hauls itself to and fro on its path extending along the longwall face with the rotary cutter head 2 winning coal from the face. As the machine hauls itself along the chain, the links sequentially are associated with the sprocket assembly and sequentially are drivably engaged by the driven sprocket 31. Only those links of the chain currently associated with the sprocket assembly are disengaged from the track assembly 15. Thus, only those links of the chain currently associated with the sprocket assembly are under tension, the next leading link relative to those associated with the sprocket assembly is fixedly engaged with its associated pocket 22 and takes the hauling force of the machine. All the remaining links of the machine which are accommodated within the track assembly pockets 22 along the whole length of the face are slack and not tensioned. Thus, with equipment constructed in accordance with the present invention there is no long length of tensioned chain. Consequently, the disadvantages associated with long length of tensioned chain are not encountered.

Also, since the sprocket assembly is engaged by a flexible round link chain it is not necessary to have an elonated track manufactured to a high tolerance. Consequently the cost of the track assembly tends to be relatively inexpensive.

I claim:

1. Mineral mining equipment comprising a mineral mining machine which is use traverses to and fro along a path adjacent to an armored face conveyor arranged along a mineral face and which has a sprocket assembly including at least one driven sprocket, a flexible round link chain at least a portion of which is extendable along at least a portion of the path of the machine such that during the traverse of the machine along the path links of the chain are associated with the sprocket assembly and sequentially are drivably engaged by the driven sprocket to haul the machine along the path, and a track component securable to the armored face conveyor, the track component having formations for fixedly engaging those links of the chain which currently are not being fed around the sprocket assembly which is arranged to feed the associated links in sequence from the track component around the driven sprocket at back to the track component, in which the mining machine comprises a scraper blade arranged to pass along the track component to clear the track component of any broken mineral before the chain links are re-engaged with the track component.

2. Mineral mining equipment as claimed in claim 1, in which the formations are plural spaced interconnected with a continuous groove.

3. Mineral mining equipment as claimed in claim 2, in which the mining machine has feet which slide along the track component to captivate the chain to the track component.

4. The mineral mining equipment comprising track means for movably supporting a mineral mining machine, mounting means connected to the track means for anchoring the track means to a fixed object, plural spaced pockets connected to the track means and extending along the track means for fixedly engaging alternating links of a chain, and a continuous groove extending along the track and interconnecting all of the pockets of the track, for receiving intermediate lengths of a chain between the alternating links of chain, the groove extending inward from the pockets, whereby the groove may be cleaned by cleaning means passing through the groove, a machine mounted on the track means and having a scraper means extending into the continuous groove for scraping the continuous groove as the machine moves along the track means.

5. The mineral mining equipment of claim 4 further comprising a length of chain having opposite ends and means anchoring the opposite ends of the length of chain to opposite ends of the track means, the length of chain having plural links which are alternately positioned at least partially within the pockets and within groove means between the pockets.

6. The mineral mining equipment of claim 5 further comprising a mineral mining machine mounted on the track and having lifting means connected to the chain for lifting the chain from the pockets and groove means and having a drive sprocket engaging the chain for driving the mineral mining machine along the chain and along the track as the drive sprocket turns.

7. The mineral mining equipment of claim 6 wherein the mineral mining machine has means spaced outward from the lifting means with respect to the drive sprocket for urging the chain into the pockets and groove means.

* * * * *